United States Patent [19]

Walker

[11] 4,027,754

[45] June 7, 1977

[54] WHEELED SUITCASE

[76] Inventor: Brooks Walker, 807 Francisco St., San Francisco, Calif. 94109

[22] Filed: Feb. 26, 1976

[21] Appl. No.: 661,655

[52] U.S. Cl. ..... 190/18 A; 16/137; 280/47.34

[51] Int. Cl.[2] ..... A45C 5/14

[58] Field of Search ..... 190/18 A; 16/30, 38, 16/137, 43; 280/47.13 R, 47.24, 47.26, 47.34

[56] References Cited

UNITED STATES PATENTS

| | | | |
|---|---|---|---|
| 468,195 | 2/1892 | Fleming | 16/38 |
| 498,130 | 5/1893 | Mankey | 16/38 |
| 1,349,088 | 8/1920 | Noelting | 16/38 |
| 1,541,280 | 6/1925 | Replogle | 16/30 |
| 1,642,502 | 9/1927 | Krasberg | 280/35 |
| 2,070,557 | 2/1937 | Bartel | 16/137 |
| 2,409,786 | 10/1946 | Norton | 280/47.26 |
| 2,919,138 | 12/1959 | Brower | 190/18 A X |
| 3,362,358 | 1/1968 | Farish | 16/137 X |
| 3,526,921 | 9/1970 | Aupke | 190/18 A X |
| 3,797,067 | 3/1974 | Rodgers | 190/18 A X |

*Primary Examiner*—Donald F. Norton
*Attorney, Agent, or Firm*—Gordon Wood

[57] ABSTRACT

A wheeled suitcase wherein the wheels are easily removed and attached to the suitcase. The axles of the wheels are received in sleeves which are integrally connected to the hinges of the suitcase in order to facilitate manufacture. A detent is provided for releasably securing the axles in place. In one form of the invention the detent is protected from damage by a housing which is also integral with the hinges.

10 Claims, 7 Drawing Figures

WHEELED SUITCASE

This invention relates to suitcases of the type provided with ground wheels to facilitate transporting the same. Since such ground wheels are subject to damage when being transported by carriers it is important that the wheels be readily removable before the suitcase is turned over to the carrier.

The main object of the present invention is the provision of a wheeled suitcase wherein the means for mounting the wheels is economical to manufacture by being formed integral with the hinge structures.

Another object of the invention is the provision of a wheeled suitcase having readily removable and attachable wheels and which suitcase is constructed so as to have no unnecessary projections subject to damage.

Yet another object of the invention is the provision of a wheeled suitcase wherein the axles of the wheels are releasably secured to the suitcase so as to prevent accidental removal of the wheel structures and at the same time provide a simple and quick means for releasing the wheel axles.

Other objects and advantages will be apparent from the following specification and from the drawings.

Figure 1:
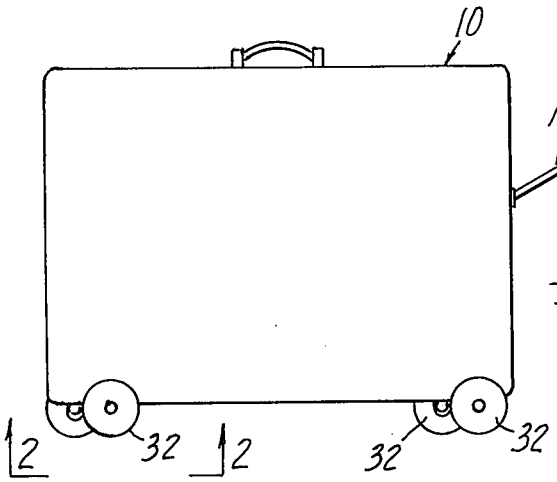
FIG. 1 is a side elevation of a wheeled suitcase made in accordance with the invention.
Figure 2:
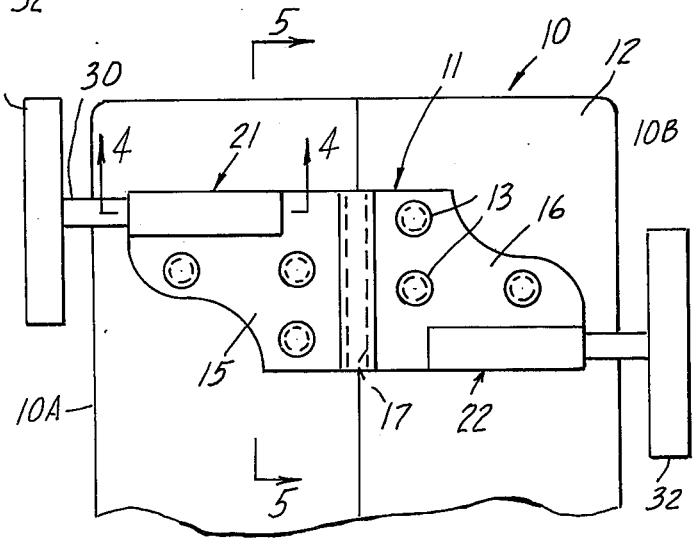
FIG. 2 is a fragmentary bottom plan view of the suitcase showing one pair of wheels attached thereto.
Figure 3:
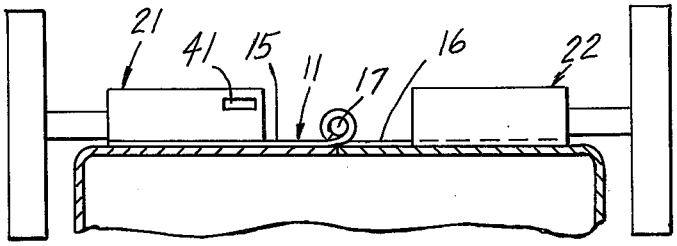
FIG. 3 is a cross sectional view through the bottom of the suitcase of FIG. 2 showing the wheels attached.

In detail, and first with reference to FIGS. 1 to 3 a conventional suitcase 10 is formed by two opposed portions 10A and 10B which are hingedly secured together by two or more hinge structures one of which is generally designated 11 in FIG. 2. Said hinge structures 11 are usually secured to the bottom 12 of the suitcase by means of rivets 13 or similar fastening elements. The suitcase may be pulled by any desired means such as a tether 14.

Each hinge structure preferably comprises a pair of similar hinge leaves 15, 16 which are swingably mounted together by means of hinge pins 17.

Figure 4:
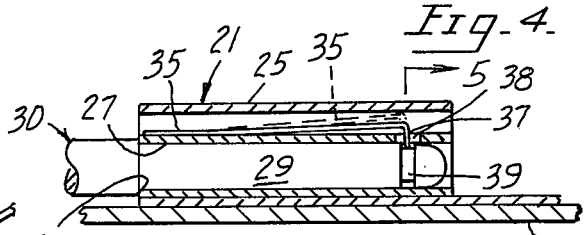
FIG. 4 is an enlarged sectional view through the wheel axle with the suitcase inverted and showing the mounting means therefor.
Figure 5:
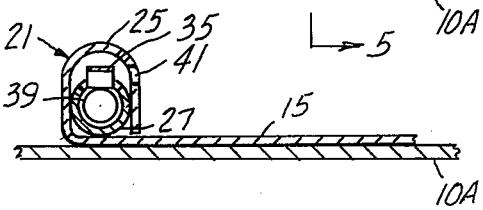
FIG. 5 is a vertical cross sectional view through the axle and its housing as taken in a plane indicated by lines 5—5 in FIG. 4.

By the present invention the sheet material from which leaves 15, 16 are made is preferably provided with extensions which are bent as best seen in FIGS. 4 and 5 to provide a pair of housings 21, 22. These housings are identical and only housing 21 is shown in detail in FIGS. 4 and 5. As best seen in FIG. 5 each housing comprises a closed loop which is vertically elongated and formed to provide a curved lower surface 25 which constitutes a bearing surface for receiving the weight of the suitcase thereon when said suitcase is transported without wheels. Fixedly secured in housing 21 by rolling an extension of the hinge or by welding is an elongated sleeve 27 which is adapted to slidably receive therein the outer portion 29 of wheel axle 30 which rotatably carries the wheel 32. Said outer portion 29 is of slightly less diameter than the remainder of axle 30 to provide a shoulder 31 which acts as a stop to limit the movement of outer portion 29 into the sleeve 27.

Interposed between the sleeve 27 and the bottom curved portion 26 is an elongated leaf spring 35 which is secured at one end as by welding to sleeve 27 and which is formed at its other end with a laterally offset portion 37 extending through an opening 38 in sleeve 27 and into an annular groove 39 formed on the outer portion 29 of shaft 30. It will be noted that the offset portion 37 of flat spring 35 is urged into groove 39 by its own resiliency so that when the axle 30 is applied the flat spring 35 automatically snaps into the groove 39 thereby holding the axle 30 against accidental removal. One side of housing 21 is provided with an opening 41 (FIG. 5) through which a tool such as a knife may be inserted to permit manual retraction of the leaf spring 35 to the dotted line position shown in FIG. 4 so that the axle 30 may be removed.

The above described structure not only provides a simple and economically formed bearing element for supporting the suitcase, but also provides protection against damage to the relatively delicate leaf spring 35.

Figure 6:
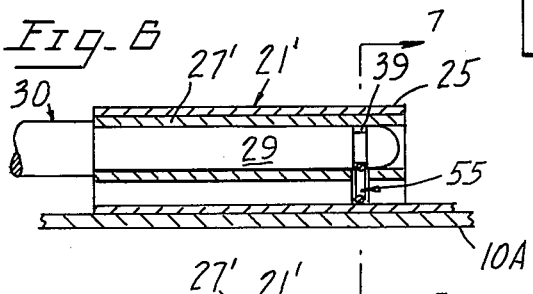
FIG. 6 is a view similar to FIG. 4 showing a modified axle attaching means.
Figure 7:
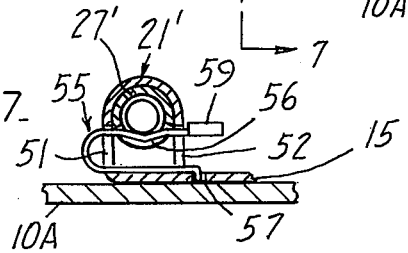
FIG. 7 is a cross sectional view through the axle taken in a plane indicated by lines 7—7 of FIG. 6.

Another form of the invention is shown in FIGS. 6, 7 wherein the housing 21' is similar to the above described housing 21. However, in this case the sleeve 27' is fixedly secured against the inner side of the lower curved surfact 35 as best seen in FIG. 7. The housing 21' is formed with a pair of vertically extending slots 51, 52 in registration with the annular groove 39 of shaft 30. Received through said slots 51, 52 is a generally U-shaped spring clip 55, one leg of which is provided with a joggled portion 56 adapted to be received within the groove 39 as best seen in FIG. 7. One end of the clip 55 may be bent to be received within an opening 57 in leaf 15 and the other end may be provided with a manually actuatable button 59 which is adapted to be pressed to move the spring clip 55 out of engagement with the groove 39 when it is desired to remove the axle 30.

It will be understood that four of the above described wheel receiving structures are provided, two wheels being attached to one hinge structure and two wheels to another.

If desired, the hinge leaves 15, 16 may be designed so that the axles carried by said leaves are sufficiently far apart that the suitcase may be opened with the wheels thereon and with the wheels clearing each other.

I claim:

1. In a suitcase having two opposed portions and provided with a plurality of hinge structures on one side thereof for hingedly mounting said portions together, a sleeve integrally secured to one of said hinge structures, and a wheel assembly including an axle received in said sleeve for supporting said suitcase, said axle being formed with an annular groove, a detent carried by said hinge structure and received in said groove, and a housing surrounding said sleeve for protecting said detent.

2. A suitcase according to claim 1 wherein a leaf of said hinge structures and said housing are formed from a unitary section of sheet material.

3. A suitcase according to claim 1 wherein said housing is provided with an opening for receiving a tool therethrough to release said holding means.

4. In a suitcase having two opposed portions and provided with a plurality of hinge structures on one side thereof for hingedly mounting said portions together, an elongated sleeve integrally secured to each leaf of each hinge structure and extending in a direction parallel to said one side, and a wheel assembly including an axle received in each sleeve for supporting said suitcase.

5. A suitcase according to claim 4 wherein holding means is provided for holding said axle in said sleeve against removal.

6. A suitcase according to claim 5 wherein said holding means comprises an annular groove in said axle and a detent carried by said hinge structure and received in said groove.

7. A suitcase according to claim 6 wherein said detent is an elongated flat spring having an offset end portion received in said groove.

8. A suitcase according to claim 6 wherein said detent is a generally U-shaped spring having a portion thereof received in said groove.

9. A suitcase according to claim 4 wherein each of said hinge structures comprises a pair of leaves swingably secured together, a sleeve integrally secured to each of said leaves for receiving a pair of wheel axles.

10. A suitcase according to claim 9 wherein said sleeves are staggered longitudinally of said one side to clear each other when said suitcase is opened.

* * * * *